United States Patent [19]

Barkley

[11] Patent Number: 4,688,633

[45] Date of Patent: Aug. 25, 1987

[54] WELLHEAD CONNECTING APPARATUS

[76] Inventor: Stephen H. Barkley, R.R. 1, Site 1, Box 24, Red Deer, Alberta, Canada, T4N 5E1

[21] Appl. No.: 844,081

[22] Filed: Mar. 26, 1986

[30] Foreign Application Priority Data

Apr. 4, 1985 [CA] Canada ..... 478521

[51] Int. Cl.[4] ..... E21B 33/03

[52] U.S. Cl. ..... 166/92; 166/341; 166/368; 285/402; 285/920

[58] Field of Search ..... 166/85, 92, 93, 94, 166/338, 341, 340, 368, 363, 364, 365; 285/920, 360, 361, 376, 396, 401, 402, 18

[56] References Cited

U.S. PATENT DOCUMENTS

| | | | |
|---|---|---|---|
| 2,317,404 | 4/1943 | Rearwin | 166/85 |
| 3,220,245 | 11/1965 | Van Winkle | 166/341 X |
| 4,209,891 | 7/1980 | Lamb et al. | 166/341 X |
| 4,361,353 | 11/1982 | Vinson | 285/401 X |
| 4,460,156 | 7/1984 | Hazelrigg et al. | 166/341 X |

FOREIGN PATENT DOCUMENTS

| | | | |
|---|---|---|---|
| 2081831 | 2/1982 | United Kingdom | 285/920 |

*Primary Examiner*—Stephen J. Novosad
*Assistant Examiner*—David J. Bagnell
*Attorney, Agent, or Firm*—Anthony J. Casella; Gerald E. Hespos

[57] ABSTRACT

A coupling assembly for detachably connecting a pair of wellhead members, includes couplable first and second coupling members. Each coupling member has a central axial bore for accommodating a drill string, and each coupling member is adapted for axially aligned connection to a wellhead member. The first coupling member is axially rotatable relative to the second coupling member, into locking engagement therewith. The coupling also includes sealing means disposed between the coupling members, and means for rotating the first member relative to the second member.

7 Claims, 4 Drawing Figures

WELLHEAD CONNECTING APPARATUS

The present invention relates to the field of wellhead components, and couplers for wellhead components.

A wellhead, as referred to herein, is that portion of an oil or gas well located directly on, and securely fastened to the earth's crust. It may either be on on-shore wellhead, such as those found in Alberta, where the wellhead is easily accessible, as it is exposed to the atmosphere, or an off-shore wellhead, such as those in the North Sea, where access to the wellhead is difficult, as it will be hundreds, or even thousands of feet under water. The wellhead is comprised of a variety of different components, typically including pumps, drilling equipment, and blow-out preventers. Extending downwardly into the earth's crust from the wellhead to an oil or gas pocket is the well, and in the well, a drill string is situated.

A drill string is a series of pipes, each designed to be capable of withstanding the potentially high pressure generated by the release of natural gas or oil from an oil or gas pocket. The pipes are connected together in series by larger diameter collars, also designed to be capable of withstanding high fluid pressures.

Since fluid pressures in a well are to a great extent unpredictable, it is not uncommon for a well to blow-out. That is, often, the fluid pressures in a well will cause a drill string to rupture or separate at a coupling, and the result is that gas or oil will flow unrestricted up the well into the wellhead.

This can be accompanied by the extremely dangerous ejection of a piece of drill string from the well, and by the rapid escape of highly flammable natural gas from the wellhead. It is also possible for drill string to accidentally drop down the well if it ruptures. In any event, the consequences of a blow-out are quite onerous, in that during any blow-out human life is in danger, and a great deal of money will be lost while the blow out is being remedied. Moreover, it is not unusual, given the current state of technology, for a blow out to take several weeks to repair.

Typically, a blow-out is remedied by sealing-off the wellhead as quickly as possible, and pumping water into the well, to cap the flow of hydrocarbon by establishing a column of water in the well which will equalize pressures in the well. The wellhead is sealed by means of blow-out preventers, such as those shown in Canadian Pat. No. 1,136,544, issued Nov. 30, 1982 to J. Holt et al.

The principal disadvantage of known blow-out preventers is that they do not provide a reliable means of ensuring that a drill string is not dropped down a well, or ejected from a well, and secondly, that the connection of a blow-out preventer to a wellhead is a labour intensive operation. That is, blow-out preventers have to be connected to a wellhead by hand, and in the type of situation when they are most needed, or if in place, are most likely to be damaged and require replacement—during a blow-out—the wellhead is a very dangerous place for a person to be.

One object of the present invention is to provide a wellhead component for securing a drill string in a wellhead during a blow out. Another object of the present invention is to provide a coupler for use with wellhead components, whereby a wellhead component can be removed from a wellhead, or added to a wellhead quickly and from a remote location.

In one broad aspect, the present invention relates to a coupling assembly for detachably connecting a pair of wellhead members, said coupling including couplable first and second coupling members, each coupling member having a central axial bore for accommodating a drill string, and each coupling member being adapted for axially aligned connection to a wellhead member, said first coupling member being axially rotatable relative to said second coupling member into locking engagement therewith, said coupling also including sealing means disposed between said coupling members, and means for rotating said first member relative to said second member.

In another broad aspect, the present invention relates to a wellhead member for use in conjunction with a blow-out preventer, to prevent slippage of a drill string while said blow-out preventer is being actuated, comprising a body having a centrally apertured bore for accommodating a drill string, at least a pair of mutually opposed rams mounted in the said body, for movement radially, relative to said bore and at least a pair of mutually opposed blocks mounted in said body adjacent said bore, and moveable by said rams against a drill string in said bore, the surface of said blocks adjacent said bore being adapted to graspingly engage said drill string and thereby prevent it from slipping.

In drawings which illustrate, by way of example, embodiments of the present invention:

Figure 4:
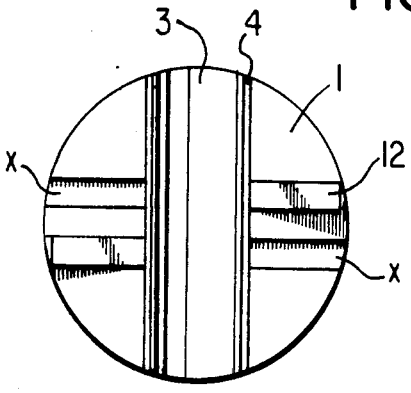

FIG. 4 a front view of an anti-slip block employed in the wellhead component of the present invention.

Figure 1:
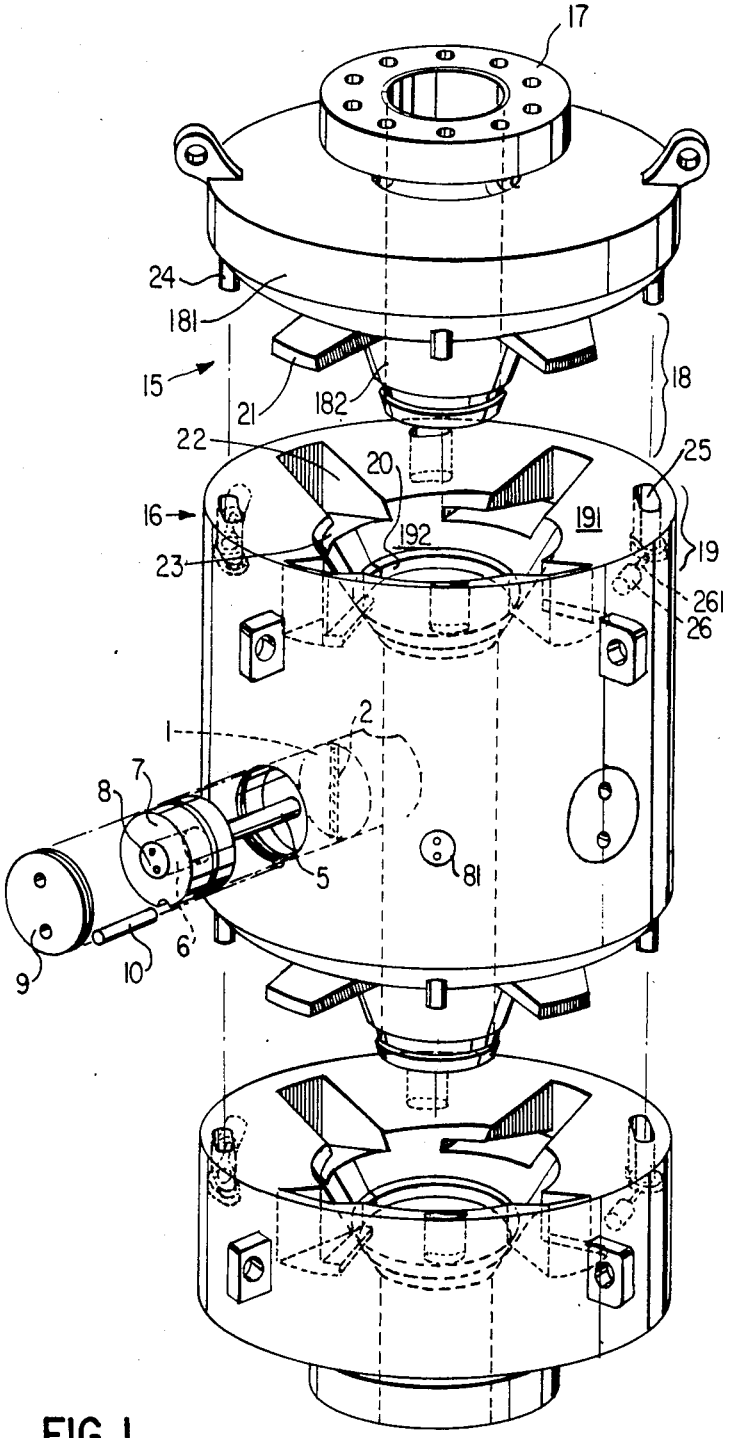
FIG. 1 is a perspective view, partially exploded, of wellhead component of the present invention, provided with the couplers of the present invention.
Figure 2:
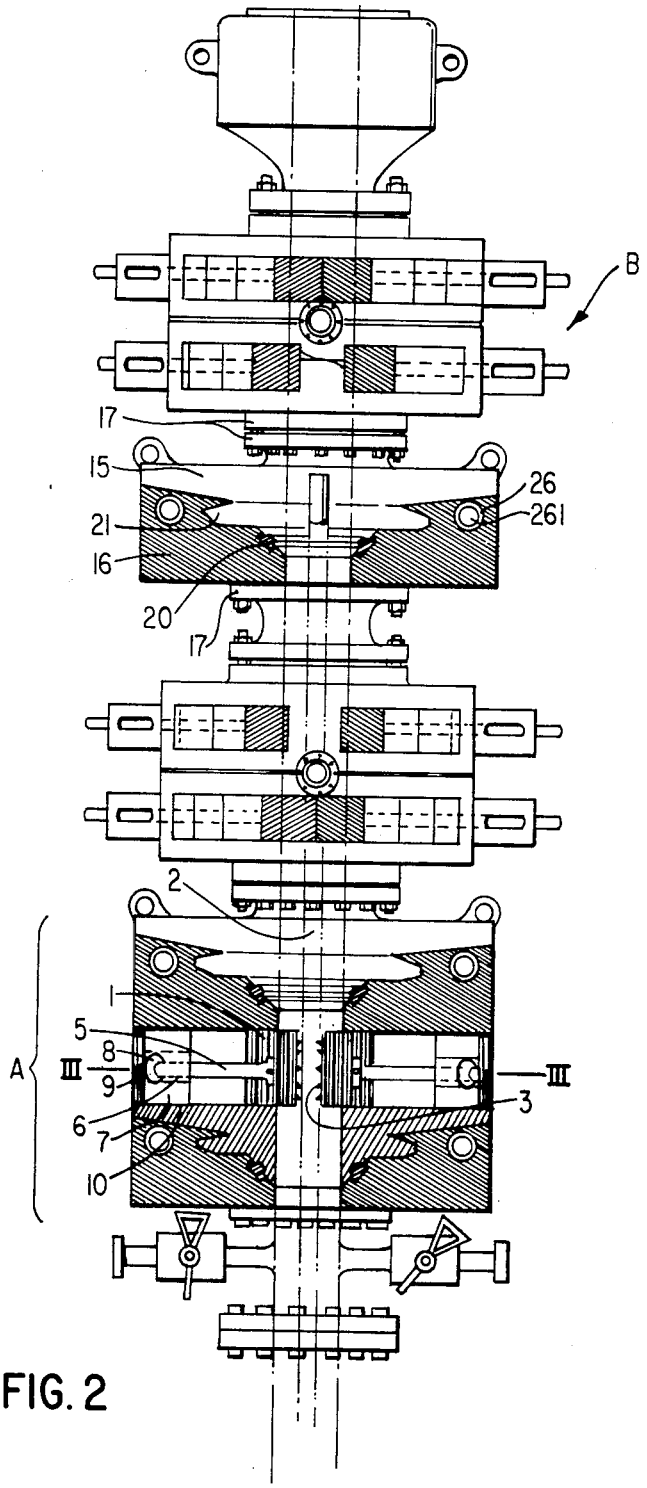
FIG. 2 is a longitudinal cross-sectional view of a wellhead provided with the wellhead component and couplers of the present invention.

Referring first to FIG. 1, a partially exploded view of the wellhead component of the present invention is shown, together with a pair of wellhead member couplings of the present invention. The wellhead component A of FIG. 1 is intended to be used in conjunction with and below known blow-out preventers, (see FIG. 2) to safely ensure that drill string in a well remains immobile at any required time, *especially* during a blow-out combatting operation.

Component A has a body which is provided with a cylindrical bore along its central longitudinal axis, for accommodating a drill string. At each end of the body, component A is adapted for connection to the novel wellhead coupling members of the present invention. These coupling members, as well as the appropriate adaptation of component A thereto will be described in more detail, below.

In the central portion of the body of component A, arranged in recesses around the axial bore are provided two pairs of mutually opposed anti-slip blocks 1. Each anti-slip block 1 is movable to and from the bore in a plane normal to the bore, and, as can better be seen in FIG. 2, the face of each anti-slip block adjacent the bore is adapted to accommodate the cylindrical surface of a drill string 2, and further, in the area of such adaptation, is provided with a series of sharp ridges 3 running perpendicular to the bore. Urging of a mutually opposed pair of anti-slip blocks 1 against the drill string 2 will, therefore, cause the ridged surface 3 of the blocks to graspingly engage the outer surface of the drill string 2, and the drill string will be prevented from moving either up or down. It is preferred to provide a slight upward angulation of the ridges 3 on the top half of the grasping surface of each anti-slip block 1, and a slight downward angulation on the bottom half thereof. This will result in very secure immobilization of a drill string.

Figure 3:
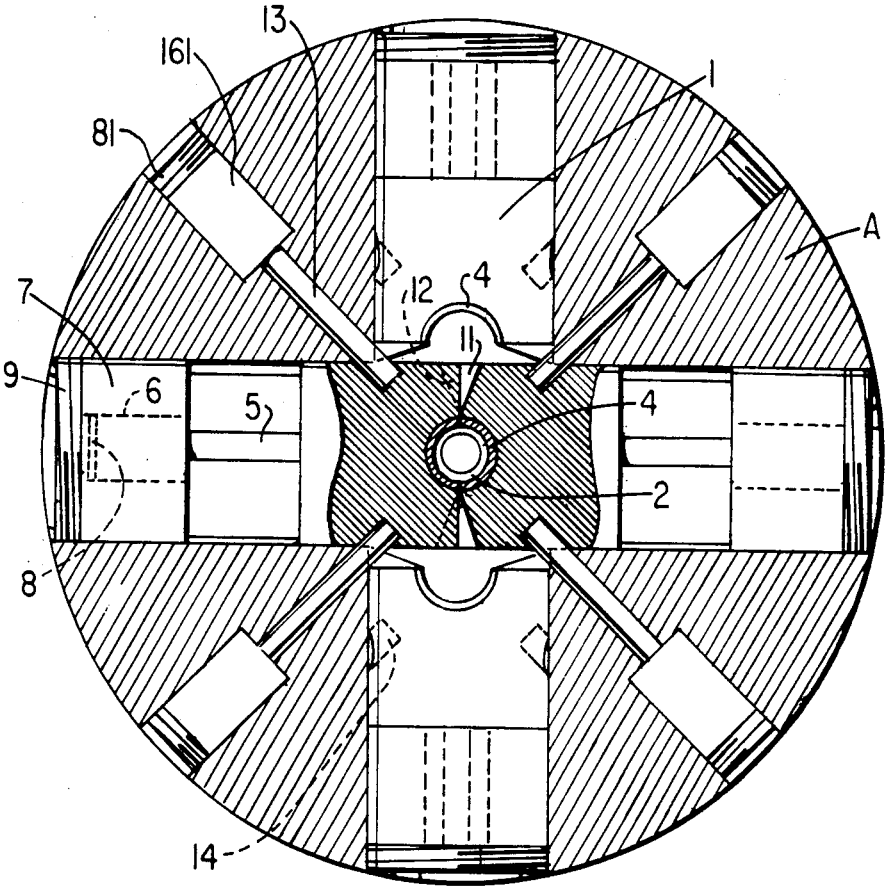
FIG. 3 is a sectional view through lines III—III of FIG. 2.

As can more clearly be seen from the cross-sectional view of FIG. 3, the pairs of anti-slip blocks are arranged so that only one pair of blocks 1 can be closed against a drill string at any one time. The reason for this is that drill pipe is typically 2⅞" in diameter, and therefore the facings on one pair of blocks are adapted to grasp a 2⅞ pipe. However, sections of pipe in a well are typically joined together by 3½ collars, so it is possible that, at the instant one may need to immobilize the drill string, a 3½" collar is opposite the anti-slip blocks. Therefore, the faces of the second pair of anti-slip collars are adapted to grasp a 3½ "collar. It will be noted that each opposing pair of blocks is retractable into the body of the component when it is desired to close the other pair.

For facility of manufacture and maintenance, it is preferred to manufacture the anti-slip blocks used in the present invention as "blanks", that is, with a semi-cylindrical groove in their face. Removable inserts 4 can be bolted into such groove, (or otherwise secured therein), and it can therefore be seen that it will only be necessary to adapt the removable inserts to graspingly engage the pipe. Maintenance of the anti-slip blocks is accordingly a simple matter. If, for instance, the pipe-grasping ridges 3 on an insert 4 become worn or broken, it will only be necessary to remove and replace the insert 4 in that block 1. Furthermore, the anti-slip blocks 1 used in each opposing pair can be the same, because only the inserts 4 need be adapted to engage different pipe sizes, and therefore few spare parts need be inventoried at a site. A further advantage of using removable inserts, instead of tooling the actual face of the anti-slip blocks, is that it allows the device of the present invention to be quickly and inexpensively modified, should there be any shift in pipe or collar sizes, either to a larger or a smaller pipe or collar size, merely by manufacturing new inserts, rather than by manufacturing new blocks.

Each anti-slip block is connected to a hydraulic shaft 5 extending normal to the bore. The shafts are in turn each connected to one of four hydraulic pistons (not shown) which are movable in four regularly spaced hydraulic cylinders 6 (shown in phantom in FIG. 3), spaced around the perimeter of the body. Each hydraulic cylinder 6 is held in a removable casing 7 and is provided with at least one, and preferably two or more ring seals around its perimeter for a tight seal between the cylinder and the casing 7.

The cylinders are held within the casing by removable screw caps 8, to facilitate maintenance of the hydraulic systems of the cylinders. The casings 7, with their associated cylinders 6 are inserted into appropriately sized openings in the body of the component A, and retained in the body of the component A by a further set of screw caps 9. For ease of manufacture of the casings 7, and tooling of the body of the component A for accommodation of the casings 7, the casings 7 are preferably cylindrical in shape, and a cylindrical keyway is bored at the lower interface between the casing and the body. This key-way accommodates a cylindrical bar 10, and the casing is, therefore, prevented from rotating within the body of the component. The keyway preferably extends into the bore in the casing far enough to act as a key-way for the anti-slip block, so that the anti-slip block is also prevented from rotating within the body.

On the face of each anti-slip block, there are provided drill string centering wedges 11, in correponding wedge receiving slots 12. As shown in detail in FIG. 4, on each face, a parallel pair of rectangular slots 12 are cut across the face of the block 1 in a direction normal to the well bore. The removable drill pipe or collar grasping insert 4 divides each of these slots 12 in two, so that, in effect, four slots are presented. Into a diagonally opposed pair x of such slots are secured a pair of wedge members (slots x shown, in FIG. 4, upper left and lower right slots, but may be in the lower left and upper right, so long as there is consistency). The wedge members 11, adjacent the perimeter of the blocks 1, extend outwardly from the face a distance substantially equal to the depth of the slots 12, and from that point, slant inwardly until, where they end adjacent the removable inserts 4, they extend only a short distance from the block face. At this point, raised wedge-like portions on the removable inserts 4 continue to slant inwardly up to that portion of the insert adapted to grasp the pipe. It will be understood that corresponding slots are provided in the inserts 4 to accommodate the wedge-like portion of the insert mounted on an opposed one of a pair of blocks 1.

The function of the pipe centering wedges is to ensure that when the anti-slip blocks 1 are closed to immobilize a pipe 2, they do not crush the pipe 2 because it is off-centre in the well. It will be understood that as the blocks 1 close, the wedges 11 from one block 1 will slip into the slot 12 on the opposite block 1, so as to create a gradually diminishing space between the blocks. The wedges 11, as the blocks 1 close, will push the pipe 2 into the centre of the well, so that it will be aligned with the portion 3 of the inserts 4 adapted to grasp it.

Referring again to FIGS. 1 and 3, four locking rams 13 are provided in component A, to securely lock a pair of anti-slip blocks 1 in place after they have been closed. One ram 14 is situated between each adjacent pair of casings 7 for the anti-slip blocks 1, and is driven by a hydraulic cylinder 161 similar to that provided for the anti-slip blocks 1. The cylinders 61 associated with the locking rams 14 are retained in suitably sized bored holes in the body of component A by sealing screw caps 81. The locking rams are insertable in suitably sized holes 14 provided in the sides of the anti-slip blocks 1. As can clearly be seen in FIG. 3, these holes extend into the blocks 1 at a 45° angle, and are alignable with the locking rams 13 only when the anti-slip blocks 1 are closed. It will further be seen that since, in fact, each locking ram 13 extends at a 45° angle to a pair of adjacent blocks 1, each ram 13 will be insertable in either one of such blocks 1, and therefore, the four locking rams 13 provided will serve to lock closed either opposed pair of anti-slip blocks 1.

It can be seen, then, with the component of the present invention in place below a blow-out preventer B, if a blow-out situation develops, the drill string 2 can quickly be immobilized, to prevent the possible ejection under pressure of the drill string from the well, or the accidental dropping of the drill string down the well, should the drill string be broken. Also, because all interior parts of the components are thoroughly sealed from the atmosphere, no hydrocarbons will be permitted to escape from the component.

As mentioned above, the present invention also provides a novel coupling for connecting together a pair of wellhead components. It should be noted that in a wellhead, there are quite a few discrete parts, such as blow-out preventors, Hydrils TM and the like. Each of these parts must be joined together with an air-tight seal between them. The present invention provides a two-piece coupler, shown in FIGS. 1 and 2 which can be affixed to any wellhead component, so that any pair of components can be quickly and efficiently joined together. Each coupler consists of a first, or upper member 15, and a second, or lower member 16. Each member is adapted, for example, by means of a flanged plate 17, to be permanently connected to a wellhead connector.

Operation of the coupler of the present invention will be described with reference to FIG. 1. The first, or upper coupling member 15 is the member shown as provided with a flanged plate 17, ready for connection to a wellhead component. The second or lower, coupling member 16 is shown as "built-in" to the wellhead component A of the present invention. It will be understood, however, that it is not necessary to build-in coupler members to the component A shown in the drawings. A lower coupling member may be attached by conventional means, such as a flanged plate to the upper end of the component, and an upper coupling member may be attached by means of a similar flanged plate to the lower end of the component. It is, however, preferable to build-in coupling members to every wellhead component, as this will obviate the need for adaptors to connect the coupling members to the wellhead components. It should also be noted that each coupling member is provided with a longitudinally extending axial bore to accommodate drill string.

The upper coupling member 15 has a lower face 18 to engage the upper face 19 of a lower coupling member 16. The faces 18 & 19 on the upper and lower members 15 & 16 are complimentarily shaped, to fit together snuggly. The face of the upper coupling member consists of an outer, annular surface 181, which may be inwardly tapered, and an inner, downwardly depending frustoconical projection. Complimentarily shaped surfaces, 191 & 192 are provided on the face of the lower coupling member 16. A hydraulically expandable ring seal 20 is provided between the frustoconical surfaces 182 & 192, so that when the two coupling members 15 & 16 are locked together, as described below, an air-tight seal is formed between them.

Around the junction between the frustoconical projection 182 and the annular surface 181 of the upper coupling member 15, there are formed four regularly spaced, radially projecting locking teeth 21. Each tooth is substantially triangular in shape, and fits into a similarly shaped locking recess 22 in the face 191 of the lower coupling member 16. As shown in FIG. 1, the annular surface 191 of the lower coupling member adjacent each locking recess 22 slants downwardly toward the recess 22, so that as the upper coupling member 15 is lowered into the lower member 16, if the locking teeth 21 on the upper member 15 are not perfectly aligned with the corresponding recesses 22 in the lower 16, they will tend to slide downwardly in the said slanted surfaces of the lower member 16, into the recesses 22.

Extending from the lower end of each locking recess is an arcuate recess 23 of a size to be selected to snuggly fit a locking tooth 21 from the upper coupling member 15. Accordingly, when the upper coupling member 15 is lowered into the lower coupling member 16 and rotated in the direction of the arcuate recesses 23, the locking teeth 21 slide snuggly into the arcuate recesses 22 to lock the coupling members 15 & 16 together. After this is done, the annular hydraulic seal 20 is pressurized, and the coupling members 15 & 16 are locked together in an air-tight coupling.

To rotate, and therefore lock, the upper coupling member 15 from a remote location, a hydraulic rotating mechanism is provided in the coupling members, as follows. Four regularly spaced, downwardly depending locking posts 24 are provided on the annular surface 181 of the face 18 of the upper coupling member 15. These four posts are insertable in four arcuate apertures 25 formed in the complimentary face 19 of the lower coupling member 16. When the locking teeth 21 are aligned in the locking recesses 22, the arcuate apertures 25 on the lower coupling member 16 will be seen to extend away from the locking posts 24 inserted therein, in the same direction as, and for the same distance as, the arcuate locking recess 23 provided in the lower coupling member 16 for holding the locking teeth 21.

Directly beneath each of a pair of diametrically opposed arcuate apertures 25 is positioned a hydraulic cylinder 26 with a shaft 261 extending from a piston (not shown) associated therewith, in a plane normal to the bore. The end of the shaft remote from its associated piston is provided with means, such as an integrally formed ring or eyelet to engage a locking post 24 extending through the associated arcuate aperture 25. Accordingly, activation of these hydraulic locking cylinders will urge the locking posts 24 toward the other end of the arcuate apertures 25 and will rotate the upper coupling members 15, thus urging the locking teeth 21 into the arcuate recesses 22 in the lower coupling member 16. Subsequent withdrawal of the shaft 261 will, of course, rotate the upper coupling member 15 in the opposite direction, and unlock the coupler.

One particular advantageous use of the coupler of the present invention is as a means of remotely connecting wellhead components in off-shore wells. Typically, an offshore well comprises a wellhead, mounted on a concrete platform on the ocean floor, and an oil rig directly above the platform, either on stilts or floating. The drill string runs between the wellhead and the rig. For safety's sake, an entire set of blow-out protectors, including, according to the present invention the anti-slip component A of the present invention, should be installed on the wellhead platform. At very shallow depths, these components can be installed by divers, but this is time-consuming, costly, and dangerous work. At greater depths, it is currently necessary to lower the components by cable, or with the drill string, to the wellhead platform, and position them with the aid of remote television cameras. Accordingly, it is very desirable to use components which are as self-aligning as possible, require little maintenance, and require little manouvering once aligned, to be locked together. Employing the couplers of the present invention to couple various wellhead components of an off-shore well together will, it can be seen, provide each component with a desirable self-aligning ability, relative to the other components of the wellhead, will require very little maintenance, as there are few moving parts in each coupler, and will require virtually no manouvering whatsoever, once a component is axially aligned with the one below it. It should be noted though, that when the coupler or anti-slip component of the present invention is used in an off-shore application, it should be provided with a corrosion-resistant exterior finish.

In a preferred embodiment in association with component A of the present invention there is also provided a failsafe system (not illustrated) for ensuring that drill string is not accidentally pulled from the well by a derrick operator whilst the component A of the present invention is actuated. That is, it will be understood that it is very dangerous to operate a derrick and pull the drill string from the well while component A is holding the drill string immobile in the well, as such activity could lead to a collapse of the derrick into the well. It will further be noted that the failsafe system (to be described below) is also applicable to conventional blow-out preventers. The failsafe apparatus of the present invention functions as follows.

As explained previously, the anti-slip blocks contained in the component A of the present invention are hydraulically actuated. There will, therefore, be a hydraulic line running from each hydraulic cylinder in component A from a reservoir and a hydraulic line running from a pump to each hydraulic cylinder in component A. These hydraulic lines have not been shown in the drawings appended hereto for the sake of simplicity of illustration, as they are conventional.

The derrick which is associated with the oil or gas well, and is used to move components from place to place and raise or lower drill string in the well, is also hydraulically actuated. The derrick is not shown in the appended drawings as it is conventional. There will, be a hydraulic line extending from the derrick motor to a hydraulic pump and a second hydraulic line extending from the derrick to a hydraulic reservoir. An interuption in the hydraulic line between the pump and the derrick will cause the derrick to cease operation. The present invention therefore provides a valve on the hydraulic line between the pump and the derrick, such valve being actuated to close that hydraulic line when there is pressure in the hydraulic line leading to the hydraulic cylinder in component A. Accordingly, when component A is being actuated, the derrick cannot be operated. It may happen that at a particular time it is desirable to actuate the anti-slip blocks of component A and operate the derrick (for example, to move components about during a blow-out). Therefore the present invention also provides a by-pass system, which is preferably a by-pass line, with a valve associated therewith to shunt fluid around the valve described above. Preferably the valve associated with this by-pass line must be held open manually when the by-pass line is to be used.

An alternative to providing a failsafe system to actually shut down operation of the derrick while a blow-out preventer or component A of the present invention is in operation is to provide an alarm system which is actuated by pressure in the hydraulic lines leading from the component A of the present invention (or BOP) combined with pressure in the hydraulic system of the derrick. Such an alarm can be in the form of a buzzer, horn or flashing light.

I claim:

1. A coupling assembly for detachably connecting a pair of wellhead members, said coupling including couplable first and second coupling members, each coupling member having a central axial fore for accommodating a drill string, and each coupling member being adapted for axially aligned connection to a wellhead member, said first coupling member being axially rotatable relative to said second coupling member into locking engagement therewith, said coupling also including an annular seal disposed between said coupling members, and means for rotating said first member relative to said second member, said first and second coupling members being provided with mutually opposed, complimentarily shaped locking faces, the locking face of said first coupling member being comprised of an annularly extending outer portion and an inner, substanially frustoconical portion, whereby when said coupling means are aligned in face to face relationship, the locking face of said first coupling member fits snuggly into the locking face of said second coupling member, said first coupling member including at least one radially extending locking tooth extending from the frustoconical portion of its locking face, and said second coupling member including at least one slot formed in its locking face corresponding with said tooth, and extending from said slot, an arcuate recess, whereby rotation of said first coupling means, after it is lowered into said second coupling means, causes said tooth to slide into said recess; said annular seal being hydraulically expandable to form a tight seal between said coupling members; and said means for rotating said first coupling member relative to said second coupling member comprising at least one locking post extending from said annular outer surface of the locking face of the first coupling member and insertable in an arcuate slot formed in the complimentary face of the second coupling member and means in said second coupling member engageable with said locking post for urging said locking post from one end of said arcuate slot to the other, whereby as said post is urged from one end of said arcuate slot to the other, the first coupling member is rotated, and the locking tooth on the first coupling member is slid into the arcuate recess in the second coupling member, thereby locking the coupling members together.

2. A coupling as claimed in claim 1, wherein said means in said second coupling member engageable with said locking post comprises a hydraulically activated piston having a shaft extending therefrom adapted to engage a said locking post.

3. A coupling as claimed in claim 2, wherein at least two regularly spaced locking teeth extend from the frustoconical portion of said first coupling member, and a corresponding number of similarly spaced slots, each with an associated arcuate recess are provided in said second coupling member.

4. A coupling as claimed in claim 3, wherein at least three regularly spaced locking teeth extend from the frustoconical portion of said first coupling member, and a corresponding number of similarly spaced slots, each with an associated arcuate recess are provided in said second coupling member.

5. A coupling as claimed in claim 4, wherein at least four regularly spaced locking teeth extend from the frustoconical portion of said first coupling member, and a corresponding number of similarly spaced slots, each with an associated arcuate recess are provided in said second coupling member.

6. A coupling as claimed in claim 5, wherein two diametrically opposed locking posts are provided on said first coupling member, and two similarly spaced arcuate slots are provided on said second coupling member, there being a hydraulic cylinder with a shaft engageable with said locking posts provided in association with a pair of diametrically opposed said arcuate slot for rotating and locking said first coupling member relative to said second coupling member.

7. A coupling as claimed in claim 5, wherein four regularly spaced locking posts are provided on said first coupling member, and four similarly spaced arcuate slots are provided on said second coupling member, there being a hydraulic cylinder with a shaft engageable with said locking posts provided in association with each of a pair of diametrically opposed arcuate slots for rotating and locking said first coupling member relative to said second coupling member.

* * * * *